US008556536B2

(12) United States Patent
Giles

(10) Patent No.: US 8,556,536 B2
(45) Date of Patent: Oct. 15, 2013

(54) ASPHALT REPAIR SYSTEM AND METHOD

(75) Inventor: Richard Giles, Park City, UT (US)

(73) Assignee: Heatwurx, Inc., Greenwood Village, CO (US)

( * ) Notice: Subject to any disclaimer, the term of this patent is extended or adjusted under 35 U.S.C. 154(b) by 0 days.

(21) Appl. No.: 13/167,888

(22) Filed: Jun. 24, 2011

(65) Prior Publication Data

US 2011/0250016 A1 Oct. 13, 2011

Related U.S. Application Data

(63) Continuation-in-part of application No. 12/651,358, filed on Dec. 31, 2009.

(60) Provisional application No. 61/358,399, filed on Jun. 24, 2010, provisional application No. 61/142,321, filed on Jan. 2, 2009.

(51) Int. Cl.
*E01C 23/16* (2006.01)
*E01C 19/22* (2006.01)

(52) U.S. Cl.
USPC ..... 404/93; 404/118

(58) Field of Classification Search
USPC ..... 404/90, 92, 93, 118–120, 75; 299/39.1, 299/39.4, 39.6; 56/7, 249, 294, 504, 56/DIG. 17, DIG. 20
See application file for complete search history.

(56) References Cited

U.S. PATENT DOCUMENTS 2,134,245 A * 10/1938 Carswell ..... 404/90
2,397,782 A * 4/1946 Flynn ..... 404/90
3,224,347 A * 12/1965 Seaman ..... 404/90
3,564,985 A 2/1971 Heller
3,625,489 A 12/1971 Weaver
3,732,023 A * 5/1973 Rank et al. ..... 404/90
3,807,886 A 4/1974 Cutler
3,820,914 A 6/1974 Zimmerman
3,874,366 A 4/1975 Cutler
3,907,450 A 9/1975 Cutler
3,965,281 A 6/1976 Takase
3,970,404 A 7/1976 Benedetti (Continued)

FOREIGN PATENT DOCUMENTS

CA 999462 11/1976
CA 1061623 9/1979

(Continued)

OTHER PUBLICATIONS

Official Action for U.S. Appl. No. 12/651,358, mailed Jun. 4, 2012 13 pages.

(Continued)

*Primary Examiner* — Thomas B Will
*Assistant Examiner* — Abagail A Risic
(74) *Attorney, Agent, or Firm* — Sheridan Ross P.C.

(57) ABSTRACT

A multipurpose asphalt processor and method for repairing damaged asphalt. The asphalt processor may be used to both till and screed asphalt surfaces. The asphalt processor may include a powered shaft having a plurality of tines extending therefrom. The outermost tines on the shaft may be angled to thereby form a beveled surface along the edges of tilled area of asphalt. The asphalt processor may further include a screed for leveling tilled asphalt. The asphalt processor may take the form of an attachment for use with existing machinery, such as a tractor.

13 Claims, 18 Drawing Sheets

(56) References Cited

U.S. PATENT DOCUMENTS 3,989,401 A 11/1976 Moench
3,997,276 A 12/1976 Jackson, Sr.
4,007,995 A 2/1977 Rofidal
4,011,023 A 3/1977 Cutler
4,018,540 A 4/1977 Jackson, Sr.
4,072,435 A 2/1978 Coho
4,084,915 A 4/1978 Wiseblood
4,124,325 A 11/1978 Cutler
4,129,398 A 12/1978 Schoelkopf
4,139,318 A 2/1979 Jakob
4,172,679 A 10/1979 Wirtgen
4,226,552 A 10/1980 Moench
4,252,487 A 2/1981 Jeppson
4,300,853 A 11/1981 Jones
4,319,856 A 3/1982 Jeppson
4,325,580 A 4/1982 Swisher, Jr.
4,335,975 A 6/1982 Schoelkopf
4,347,016 A 8/1982 Sindelar
4,407,605 A 10/1983 Wirtgen
4,453,856 A 6/1984 Chiostri
4,534,674 A 8/1985 Cutler
4,545,700 A 10/1985 Yates
4,557,626 A 12/1985 McKay
4,561,800 A 12/1985 Hatakenaka
4,594,022 A 6/1986 Jeppson
4,619,550 A 10/1986 Jeppson
4,678,363 A 7/1987 Sterner
4,711,600 A 12/1987 Yates
4,780,022 A 10/1988 Ohiba
4,793,730 A 12/1988 Butch
4,849,020 A 7/1989 Osborne
4,929,120 A 5/1990 Wiley et al.
4,938,537 A * 7/1990 Rife et al. ..... 299/39.6
4,969,772 A 11/1990 Chiba
4,969,773 A 11/1990 Heims
4,969,774 A 11/1990 Chiba
5,002,426 A * 3/1991 Brown et al. ..... 404/92
5,026,206 A 6/1991 O'Connor
5,092,706 A 3/1992 Bowen et al.
5,131,788 A 7/1992 Hulicsko
5,148,799 A 9/1992 St-Louis
5,188,481 A 2/1993 O'Brien
5,251,999 A 10/1993 McCracken
5,263,769 A * 11/1993 Pharr et al. ..... 299/39.6
5,352,275 A 10/1994 Nath et al.
5,378,079 A 1/1995 Omann
5,385,426 A 1/1995 Omann
5,388,893 A 2/1995 Maxwell et al.
5,405,213 A 4/1995 O'Connor
5,419,654 A 5/1995 Kleiger
5,439,313 A 8/1995 Blaha
5,472,292 A 12/1995 Wiley
5,484,224 A 1/1996 Lynch
5,549,412 A 8/1996 Malone
5,607,022 A 3/1997 Walker et al.
5,618,132 A 4/1997 Fogg et al.
5,630,677 A 5/1997 Barroso
5,653,552 A 8/1997 Wiley et al.
5,722,789 A * 3/1998 Murray et al. ..... 404/90
5,749,674 A 5/1998 Wilson, Sr.
5,752,782 A 5/1998 Hulicsko
5,755,865 A 5/1998 Lukens
5,766,333 A 6/1998 Lukens
5,791,814 A 8/1998 Wiley
5,795,096 A 8/1998 Culver
5,810,471 A 9/1998 Nath et al.
5,848,755 A 12/1998 Zickell et al.
5,895,171 A 4/1999 Wiley et al.
5,899,630 A 5/1999 Brock
5,928,746 A 7/1999 Dalton et al.
5,938,130 A 8/1999 Zickell
5,947,634 A 9/1999 Robillard
5,947,636 A 9/1999 Mara
5,967,695 A 10/1999 Vural
5,988,935 A 11/1999 Dillingham
5,997,724 A 12/1999 Lukens
6,049,658 A 4/2000 Schave et al.
6,074,128 A 6/2000 Marino
6,117,227 A 9/2000 Kitagawa
6,139,612 A 10/2000 Kitagawa et al.
6,186,700 B1 2/2001 Omann
6,213,559 B1 * 4/2001 Stevens ..... 299/36.1
6,214,103 B1 4/2001 Kitagawa
6,220,782 B1 4/2001 Yates
6,227,620 B1 5/2001 Page
6,227,762 B1 5/2001 Van Velsor
6,290,152 B1 9/2001 Zickell
6,318,928 B1 11/2001 Swearingen
6,371,689 B1 4/2002 Wiley
6,394,696 B1 5/2002 Culver
6,398,453 B1 6/2002 Stegemoeller
6,416,249 B1 7/2002 Crupi
6,422,784 B1 7/2002 Pellegrino et al.
6,439,804 B1 8/2002 Crupi
6,439,806 B1 8/2002 Dillingham
6,497,930 B1 12/2002 Petermeier
6,551,017 B1 4/2003 Strassman
6,584,414 B1 6/2003 Green et al.
6,588,973 B1 7/2003 Omann
6,599,057 B2 7/2003 Thomas et al.
6,659,684 B1 12/2003 Goodhart et al.
6,669,467 B2 12/2003 Kieswetter
6,681,761 B2 1/2004 Dillingham
6,682,261 B1 1/2004 Karamihas et al.
6,685,465 B2 2/2004 Marquardt
6,695,530 B2 2/2004 Crupi
6,764,542 B1 7/2004 Lackey et al.
6,769,836 B2 8/2004 Lloyd
6,802,897 B1 10/2004 Lackey et al.
6,805,738 B2 10/2004 Tasaki
6,821,052 B2 11/2004 Zurn
6,872,072 B2 3/2005 Kieswetter
6,939,079 B2 9/2005 Lloyd
6,988,849 B1 1/2006 Zimmerman
7,004,675 B2 2/2006 Wayne
7,008,670 B1 3/2006 Freisthler
7,037,036 B2 5/2006 Strassman
7,037,955 B2 5/2006 Timcik et al.
7,070,244 B2 7/2006 Fischer et al.
7,077,601 B2 7/2006 Lloyd
7,104,724 B2 9/2006 Terry
7,134,806 B2 11/2006 Lazic
7,140,693 B2 11/2006 Dubay et al.
7,150,420 B2 12/2006 Packer et al.
7,152,820 B1 12/2006 Baker et al.
7,179,018 B2 2/2007 Hall et al.
7,201,536 B1 4/2007 Westbrook et al.
7,252,455 B2 8/2007 Larsen
7,275,890 B2 10/2007 Thomas et al.
7,287,818 B1 10/2007 Hall et al.
7,297,720 B2 11/2007 Meyers et al.
7,387,464 B2 6/2008 Hall et al.
7,387,465 B2 6/2008 Hall et al.
7,396,085 B2 7/2008 Hall et al.
7,413,375 B2 8/2008 Hall
7,448,825 B2 11/2008 Kasahara
7,455,476 B2 11/2008 Grubba et al.
7,458,746 B1 12/2008 Zimmerman
7,470,082 B2 12/2008 Lloyd
7,473,052 B2 1/2009 Hall et al.
7,481,601 B2 1/2009 Gilchrist
7,503,202 B1 3/2009 Kadrmas
7,544,011 B2 6/2009 Hall et al.
7,544,253 B2 6/2009 Kleiger et al.
7,546,765 B1 6/2009 Janke et al.
7,549,821 B2 6/2009 Hall et al.
7,562,563 B2 7/2009 Wee
7,578,634 B2 8/2009 Velsor
7,585,128 B2 9/2009 Hall et al.
7,588,388 B2 9/2009 Hall et al.
7,591,607 B2 9/2009 Hall et al.
7,591,608 B2 9/2009 Hall et al.
7,641,418 B2 1/2010 Hall et al.
7,654,772 B1 2/2010 Zimmerman

(56) References Cited

U.S. PATENT DOCUMENTS

| | | | | |
|---|---|---|---|---|
| 7,686,536 | B2 | 3/2010 | Hall et al. | |
| 7,717,521 | B2 | 5/2010 | Hall et al. | |
| 7,726,905 | B2 | 6/2010 | Hall et al. | |
| 7,740,414 | B2 | 6/2010 | Hall et al. | |
| 7,748,789 | B2 | 7/2010 | Freeburn | |
| 7,780,373 | B2 | 8/2010 | Ustyugov | |
| 7,798,745 | B2 | 9/2010 | Hall et al. | |
| 7,845,878 | B1 | 12/2010 | Godbersen et al. | |
| 7,887,142 | B2 | 2/2011 | Hall et al. | |
| 7,909,532 | B2 | 3/2011 | Johnson et al. | |
| 7,927,413 | B2 | 4/2011 | Brock et al. | |
| 8,016,514 | B2 | 9/2011 | Broadway, III | |
| 8,016,515 | B2 | 9/2011 | Benedetti et al. | |
| 8,061,782 | B2 | 11/2011 | Hall et al. | |
| 8,079,777 | B2 | 12/2011 | Van Velsor | |
| 8,083,434 | B1 | 12/2011 | Gorman et al. | |
| 2003/0026656 | A1 | 2/2003 | Crupi | |
| 2003/0044522 | A1 | 3/2003 | Isozaki | |
| 2004/0099654 | A1 | 5/2004 | Pais | |
| 2004/0116557 | A1 | 6/2004 | Pounds et al. | |
| 2004/0160595 | A1 | 8/2004 | Zivkovic et al. | |
| 2004/0240939 | A1 | 12/2004 | Hays et al. | |
| 2006/0039756 | A1 | 2/2006 | Lemke et al. | |
| 2006/0099031 | A1 | 5/2006 | Rathe | |
| 2006/0104716 | A1 | 5/2006 | Jones | |
| 2006/0204332 | A1 | 9/2006 | Boudreau | |
| 2006/0285923 | A1 | 12/2006 | Musil et al. | |
| 2007/0116519 | A1 | 5/2007 | Haroldsen | |
| 2007/0172313 | A1 | 7/2007 | Lopez | |
| 2007/0220781 | A1 | 9/2007 | Altizer et al. | |
| 2007/0240700 | A1 | 10/2007 | Bucklew | |
| 2008/0008525 | A1 | 1/2008 | Dawson et al. | |
| 2008/0082347 | A1 | 4/2008 | Villalobos et al. | |
| 2008/0152427 | A1* | 6/2008 | Gillard et al. | 404/75 |
| 2008/0226392 | A1 | 9/2008 | Lloyd | |
| 2008/0247823 | A1 | 10/2008 | Will et al. | |
| 2008/0249729 | A1 | 10/2008 | Martinez et al. | |
| 2008/0292401 | A1 | 11/2008 | Potts | |
| 2009/0052988 | A1 | 2/2009 | Belley | |
| 2009/0116905 | A1 | 5/2009 | McDonald | |
| 2009/0136295 | A1* | 5/2009 | Boyd | 404/81 |
| 2009/0185859 | A1 | 7/2009 | Haroldsen | |
| 2009/0226254 | A1 | 9/2009 | Jones | |
| 2009/0297268 | A1 | 12/2009 | Harakawa et al. | |
| 2010/0021233 | A1 | 1/2010 | Chandler | |
| 2010/0034586 | A1 | 2/2010 | Bailey et al. | |
| 2010/0055304 | A1 | 3/2010 | Reinke et al. | |
| 2010/0104363 | A1 | 4/2010 | Benedetti | |
| 2010/0203462 | A1 | 8/2010 | Gencer | |
| 2010/0209188 | A1 | 8/2010 | Wiley | |
| 2010/0310312 | A1 | 12/2010 | Mahler | |
| 2010/0316445 | A1 | 12/2010 | Kasahara et al. | |
| 2010/0322710 | A1 | 12/2010 | Ryan | |
| 2010/0322713 | A1 | 12/2010 | Hegg | |
| 2011/0070024 | A1 | 3/2011 | Kleiger | |
| 2011/0070025 | A1 | 3/2011 | Kleiger | |
| 2011/0120443 | A1 | 5/2011 | Stothert et al. | |
| 2011/0163589 | A1 | 7/2011 | Cipriani et al. | |
| 2011/0274487 | A1 | 11/2011 | Sylvester | |
| 2011/0298188 | A1 | 12/2011 | Haubrich et al. | |
| 2012/0027513 | A1 | 2/2012 | Wang et al. | |

FOREIGN PATENT DOCUMENTS

| | | |
|---|---|---|
| CA | 1063410 | 10/1979 |
| CA | 1065843 | 11/1979 |
| CA | 1081516 | 7/1980 |
| CA | 1093365 | 1/1981 |
| CA | 1134344 | 10/1982 |
| CA | 1169318 | 6/1984 |
| CA | 1214673 | 12/1986 |
| CA | 1225857 | 8/1987 |
| CA | 1226159 | 9/1987 |
| CA | 1235935 | 5/1988 |
| CA | 1237315 | 5/1988 |
| CA | 2002058 | 5/1991 |
| CA | 1300417 | 5/1992 |
| CA | 1304251 | 6/1992 |
| CA | 2087879 | 7/1993 |
| CA | 1328334 | 4/1994 |
| CA | 2021648 | 8/1998 |
| CA | 2061682 | 3/1999 |
| CA | 2251284 | 3/1999 |
| CA | 2366009 | 9/2000 |
| CA | 2287547 | 4/2001 |
| CA | 2428367 | 5/2002 |
| CA | 2334297 | 8/2002 |
| CA | 2131429 | 11/2003 |
| CA | 2409493 | 4/2004 |
| CA | 2647593 | 10/2007 |
| CA | 2705374 | 5/2009 |
| CA | 2252250 | 7/2009 |
| CA | 2575074 | 9/2009 |
| CA | 2721990 | 5/2011 |
| EP | 560021 | 9/1996 |
| EP | 810276 | 12/1997 |
| EP | 985768 | 3/2000 |
| EP | 854235 | 3/2005 |
| EP | 1052334 | 3/2005 |
| EP | 1668185 | 6/2006 |
| EP | 1337711 | 10/2007 |
| EP | 2111436 | 10/2009 |
| EP | 2050875 | 6/2011 |
| EP | 2350390 | 8/2011 |
| EP | 2350391 | 8/2011 |
| EP | 2374934 | 10/2011 |
| WO | WO 99/41456 | 8/1999 |
| WO | WO 00/12820 | 3/2000 |
| WO | WO 00/15910 | 3/2000 |
| WO | WO 01/81894 | 11/2001 |
| WO | WO 02/14610 | 2/2002 |
| WO | WO 03/050359 | 6/2003 |
| WO | WO 2006/003466 | 1/2006 |
| WO | WO 2006/008187 | 1/2006 |
| WO | WO 2006/003466 | 3/2006 |
| WO | WO 2007/000102 | 1/2007 |
| WO | WO 2007/145576 | 12/2007 |
| WO | WO 2008/068877 | 6/2008 |
| WO | WO 2010/031530 | 3/2010 |
| WO | WO 2010/100401 | 9/2010 |
| WO | WO 2010/130143 | 11/2010 |
| WO | WO 2010/121579 | 12/2010 |
| WO | WO 2011/034731 | 3/2011 |
| WO | WO 2011/069191 | 6/2011 |
| WO | WO 2011/086722 | 7/2011 |

OTHER PUBLICATIONS

U.S. Appl. No. 13/742,928, filed Jan. 16, 2013, Cronin et al.
U.S. Appl. No. 13/777,633, filed Feb. 26, 2013, Garland et al.
U.S. Appl. No. 13/848,455, filed Mar. 21, 2013, Giles.
Official Action for U.S. Appl. No. 12/651,358, mailed May 16, 2013 12 pages.
U.S. Appl. No. 12/651,358, filed Dec. 31, 2009, Giles.
"Asphalt Processor" HEATWURX™, Heatwurx.com, date unknown, 1 page.
"Rehab Oil Rejuvanator" HEATWURX™, Heatwurx.com, date unkown, 1 page.
"RH Series Self Powered Cold Planer" ZANETIS Power Attachments, date unknown, 2 pages.
"Seamless Asphalt Repair" HEATWURX™, Heatwurx.com, date unknown, 4 pages.
Official Action for U.S. Appl. No. 12/652,358, mailed Sep. 13, 2011 Restriction Requirement, 7 pages.
Official Action for U.S. Appl. No. 12/651,358, mailed Oct. 24, 2011 10 pages.

* cited by examiner

ASPHALT REPAIR SYSTEM AND METHOD

CROSS-REFERENCE TO RELATED APPLICATIONS

This application claims the benefit of U.S. Provisional Application No. 61/358,399, filed Jun. 24, 2010, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

This application is a continuation-in-part of co-pending U.S. patent application Ser. No. 12/651,358, filed Dec. 21, 2009, which claims the benefit of priority of U.S. Provisional Application No. 61/142,321, filed Jan. 2, 2009, which are hereby incorporated by reference herein in their entirety, including but not limited to those portions that specifically appear hereinafter, the incorporation by reference being made with the following exception: In the event that any portion of the above-referenced application is inconsistent with this application, this application supercedes said above-referenced application.

STATEMENT REGARDING FEDERALLY SPONSORED RESEARCH OR DEVELOPMENT

Not Applicable.

BACKGROUND OF THE INVENTION

1. The Field of the Invention

The present invention relates generally to asphalt repair, and more particularly, but not necessarily entirely, to systems and methods for repairing voids in asphalt pavement.

2. Description of Related Art

Asphalt surfaces, such as roads, driveways, and parking lots, may suffer damage through a combination of infiltrating water and the continuous flow of moving vehicles. Water for example, may have a negative effect on the material properties of the asphalt components and their binding. Damage to asphalt may include cracks, potholes, and surface irregularities. In the past, the repair of asphalt surfaces, such as roads and parking lots, has required extensive work. Typically, repairing damage in asphalt surfaces required removing damaged sections and re-laying the sections with fresh asphalt. Disposal of the damaged asphalt may also be required. Past techniques for repairing damaged asphalt surface can be cost prohibitive and wasteful. It would therefore be beneficial to provide an apparatus, system, and method for repairing damaged asphalt in a cost efficient manner and with minimized removal of asphalt.

The prior art is thus characterized by several disadvantages that are addressed by the present invention. The present invention minimizes, and in some aspects eliminates, the above-mentioned failures, and other problems, by utilizing the methods and structural features described herein. The features and advantages of the invention will be set forth in the description which follows, and in part will be apparent from the description, or may be learned by the practice of the invention without undue experimentation. The features and advantages of the invention may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
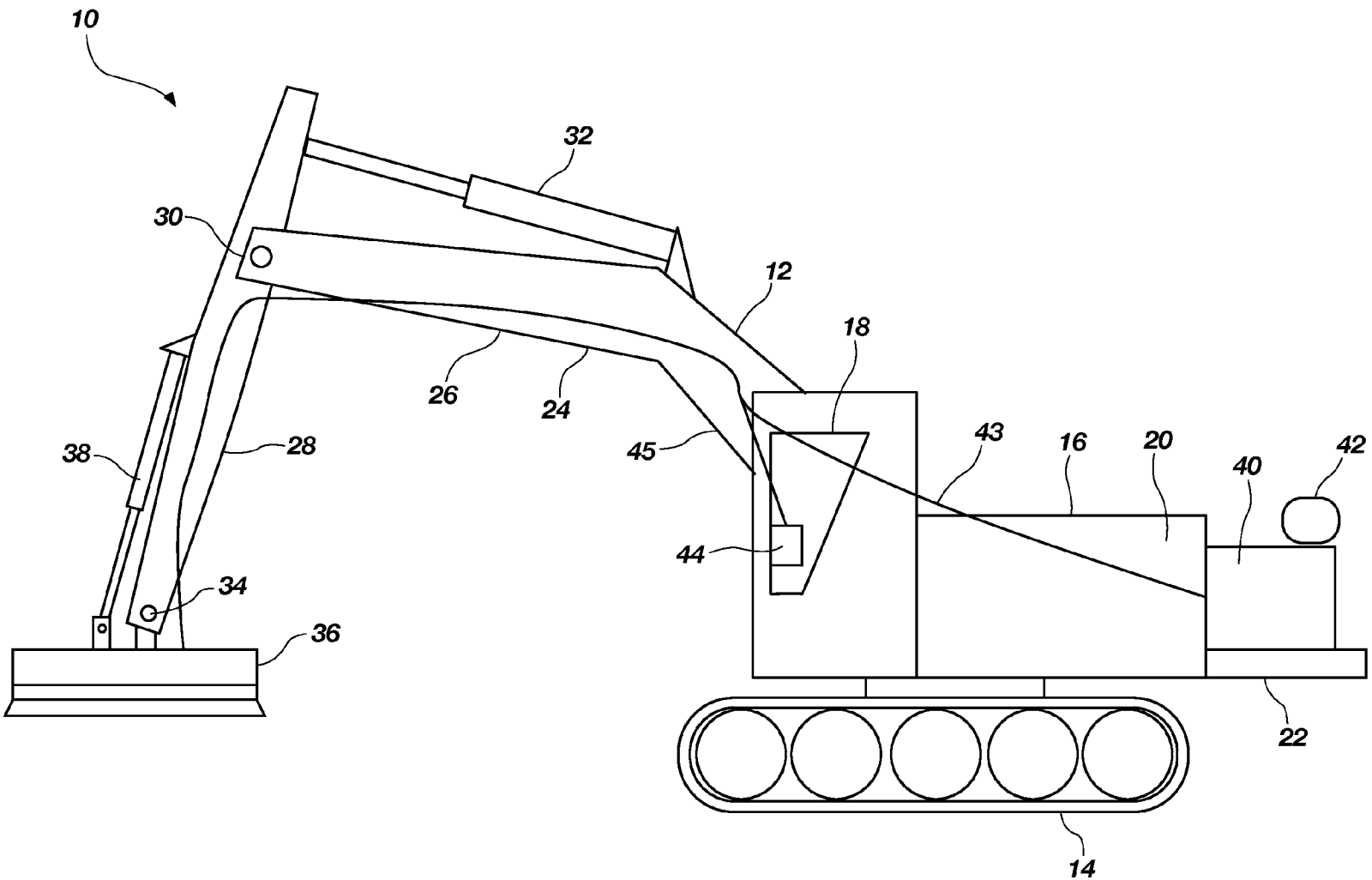
FIG. 1 depicts an exemplary embodiment of an apparatus for heating surfaces.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. As used herein, the terms "comprising," "including," "containing," "having," "characterized by," and grammatical equivalents thereof are inclusive or open-ended terms that do not exclude additional, unrecited elements or method steps.

Applicant has discovered an apparatus and method that utilize infrared radiation to heat surfaces. In an embodiment of the present disclosure, the apparatus and method may be utilized to heat surfaces covered with snow and ice. In an embodiment of the present disclosure, the apparatus and method may be utilized to heat semi-solid surfaces made from petroleum based products, such as asphalt. In an embodiment of the present disclosure, the apparatus and method may be utilized to heat any desired surface.

In an embodiment of the present disclosure, the present disclosure provides an attachment for use on a hydraulically operated arm of an excavation machine, such as a track hoe. The attachment may include a plurality of heating elements. A generator may be externally mounted to the main body of the excavating machine. The generator may provide the necessary power to the heating elements. A control panel for the heating elements may be located inside of the cab of the excavating machine such that the machine operator can control the status of the heating elements.

In an embodiment of the present disclosure, the apparatus may include a generator mounted on a movable platform. Attached to the platform may be a plurality of heating attachments. Each heating attachment may comprise a plurality of heating elements. The heating attachments may be operable between a raised position and a lowered position. When the heating attachments are in the raised position, the platform may be movable from one location to another. When the heating attachments are in the lowered position, the generator may provide power to the heating elements to thereby heat a surface, such as a snow and ice covered surface or a surface made of asphalt.

Applicant has further discovered an asphalt processor having a powered asphalt cultivator and a screed for leveling cultivated asphalt. The asphalt processor may be mounted onto a utility machine, such as compact tractor, such as a skid steer. The asphalt processor may be operable between a tilling position and a leveling position. The cultivator may include a shaft having a plurality of tines. A hydraulic motor may turn the shaft such that the tines may cultivate or breakup preheated asphalt. The screed may include a pair of opposing arms for guiding broken up asphalt into the screed such that the broken up asphalt is leveled.

Referring now to FIG. 1, there is depicted a heating system 10 pursuant to an embodiment of the present disclosure. The system 10 may comprise a machine 12 having the general form of an excavation machine, such as a track hoe or back hoe. The machine 12 may comprise a pair of tracks 14 for providing mobility to the machine 12. The machine 12 may further comprise a body portion 16 disposed above the tracks 14. The body portion 16 may rotate with respect to tracks 14.

The body portion 16 may comprise an operator compartment 18, an engine compartment 20, and a platform 22. The operator compartment 18 may comprise those necessary control interfaces that allow an operator to control the machine 12. The engine compartment 20 may house a diesel engine (not shown) for providing power to tracks 14. The diesel engine may also provide power to one or more hydraulic pumps.

Extending from the body portion 16 may be an arm or a boom 24. The boom 24 may comprise a first portion 26 and a second portion 28 pivotally interconnected at a pivot point 30. A first hydraulic cylinder 32, which gets its power from the one or more hydraulic pumps, allows an operator to move the first portion 26 of the boom 24 with respect to the second portion 28 of the boom 24 as is known to one having ordinary skill in the art.

The distal end 34 of the second portion 28 of the boom 24 may be adapted to removably receive various attachments. An infrared heater 36 is shown attached to the distal end 34 of the boom 24. A second hydraulic cylinder 38 may allow an operator to further position the heater 36. It will be appreciated that since the heater 36 is mounted to the end of the boom 24, that an operator may easily position the heater 36 close to any location within reach of the boom 24.

A diesel powered generator 40 mounted on the platform 22 may provide power to the heater 36. A dedicated fuel tank 42 may provide fuel for the generator 40. The fuel tank 42 may provide sufficient fuel for the generator 40 to operate up to eight (8) hours. The generator 40 may include an electric start. In an embodiment of the present disclosure, the generator 40 may be mounted to the platform 22 using spring mounted vibration isolators. In an embodiment of the present disclosure, the generator 40 may product about 45 KW, single phase. The generator 40 may provide power to the heater 36 via a power cable 43.

A control box 44 may be located in the operator compartment 18 for allowing an operator to control the heater 36. The control box 44 may allow an operator to turn the heater 36 off and on. The control box 44 may include a timer such that the heater 36 may be turned off after a preset amount of time. The control box 44 may be connected to the heater by control wiring 45.

Figure 2:
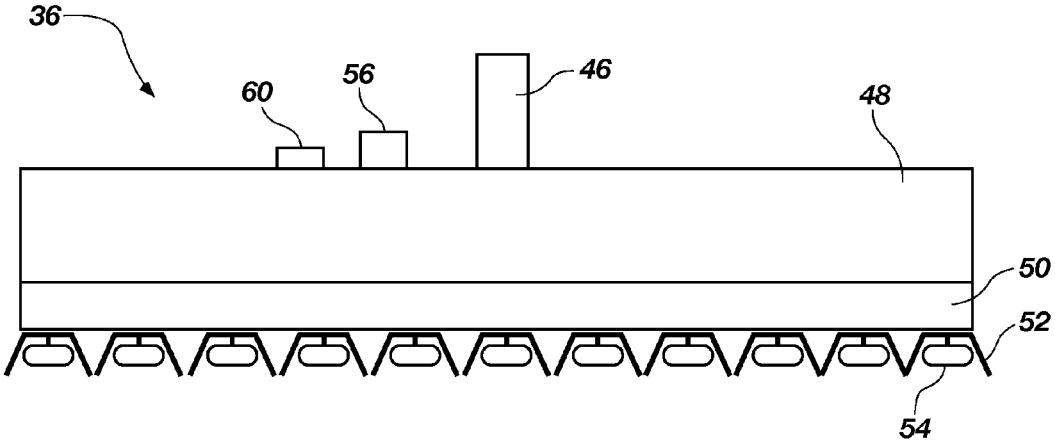
FIG. 2 is a side view of an infrared heater.

Referring now to FIG. 2, there is depicted a side view of the heater 36. The heater 36 may include a universal attachment device 46 for attaching the heater 36 to the distal end 34 of the second portion 28 of the boom 24. The attachment device 46 may extend from a base 48. Disposed on the underside of the base 48 may be an insulating layer 50. In an embodiment of the present disclosure, the insulating layer 50 may comprise ceramic material or any other type of insulator. Disposed on the underside of the insulating layer 50 may be a bank of infrared heating elements 54. Reflecting devices 52 may direct the heat generated by the heating elements 54 outwardly and away from the heater 36. An electrical coupling 56 may provide a connection for the power cable 43 and the control wiring 45.

Figure 3:
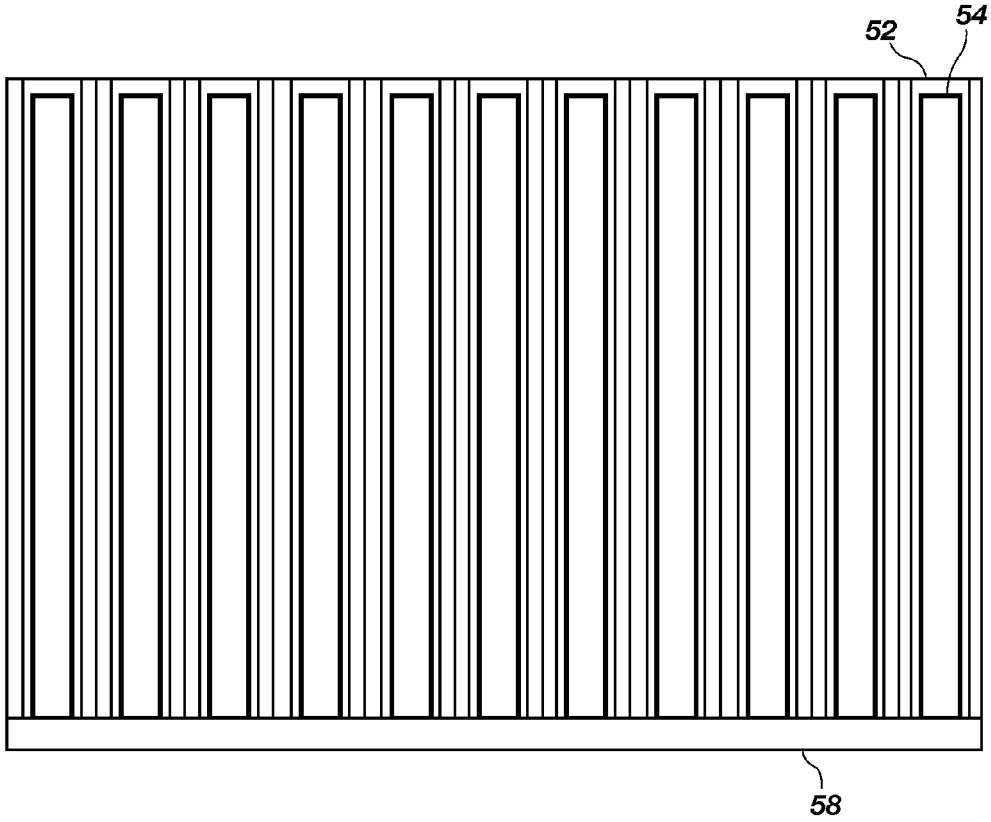
FIG. 3 is a bottom view of the infrared heater depicted in FIG. 2.

Referring now to FIG. 3, there is shown a bottom view of the heater 36. Each of the heating elements 54 may include a loop having two ends. A distribution panel 58 directs current from the generator 40 through one of the ends of the loop. The other end of the loop is connected to common. That is, current from the generator 40 is allowed to flow from one end to the other end of the loop. The passage of the current causes the elements 54 to generate heat. The more current that is allowed to pass through an element 54, the more infrared heat that will be generated. Referring back to FIG. 2, the heater 36 may further comprise a control unit 60 that is able to regulate the amount of current flowing through the heating elements 54 based upon control signals from the control box 44.

In operation, the heater 36 is able to be precisely controlled by an operator to apply heat to melt snow and ice. For example, the operator may position the heater 36 over an accumulation of snow and ice. The operator may then turn on the generator 40 to provide current to the heating elements 54. A timer may regulate the amount of time that the current is provided to the heating elements 54. Once the snow and ice has been sufficiently melted, the heater 36 may be easily re-positioned to another desired location.

It will be appreciated that in addition to melting snow and ice, the heater 36 may be utilized to heat asphalt for repair purposes. For example, the asphalt surrounding a pothole may require heating prior to applying a patch. In some instances, the heater 36 may supply sufficient heat such that additional patching material is not required.

Figure 4:
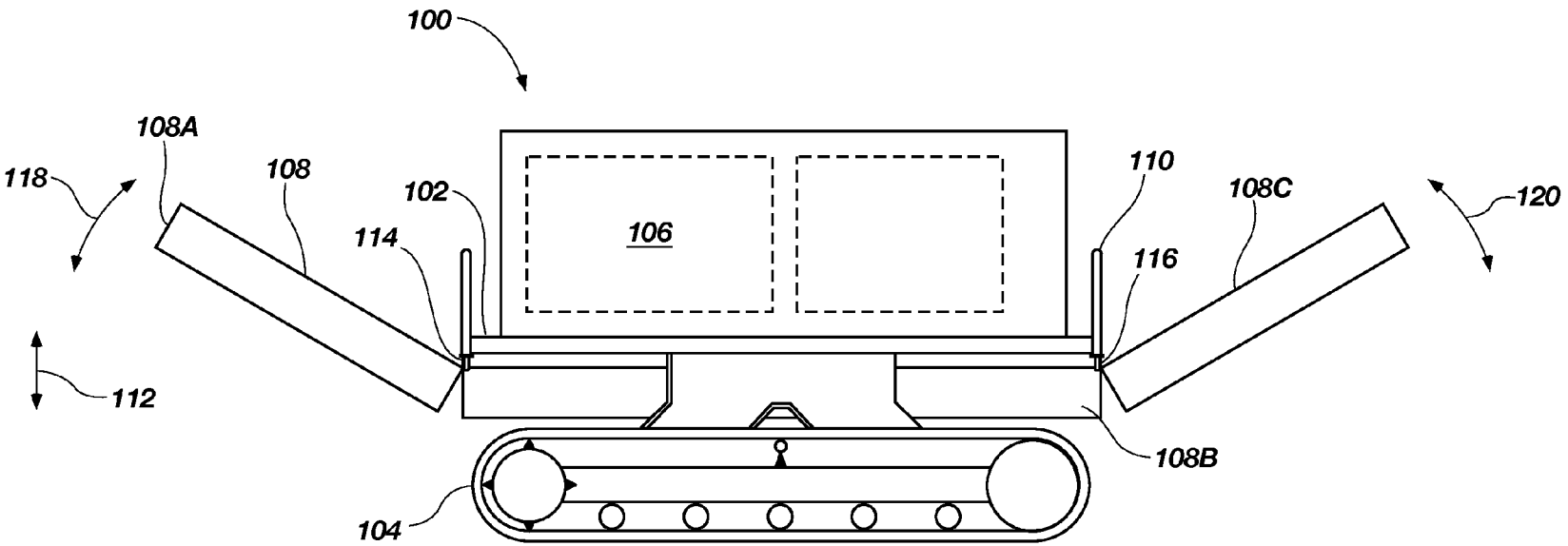
FIG. 4 is a side view of an exemplary embodiment of an apparatus for heating surfaces.
Figure 5:
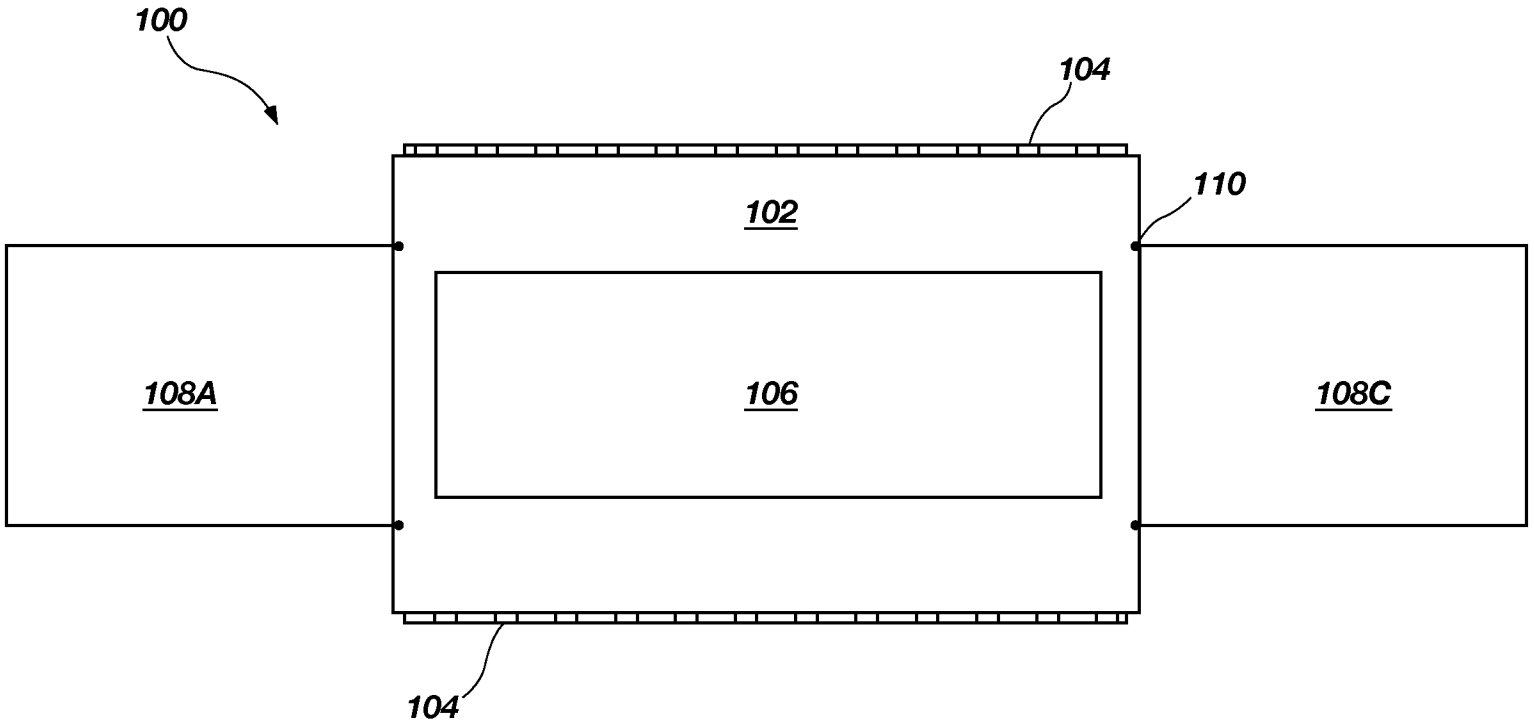
FIG. 5 is a top view of the apparatus shown in FIG. 4.
Figure 6:
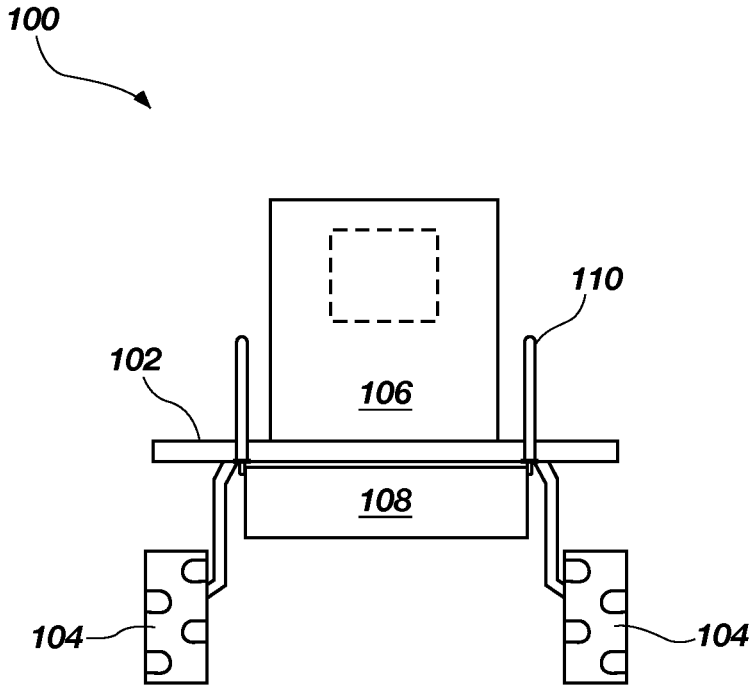
FIG. 6 is an end view of the apparatus shown in FIG. 4.

Referring now to FIGS. 4, 5 and 6, there is depicted a heating apparatus 100 pursuant to an embodiment of the present disclosure. The apparatus 100 may include a platform 102 mounted on a pair of tracks 104. In an embodiment of the present disclosure, the platform 102 may be mounted on wheels instead of the tracks 104. The tracks 104 may be driven by a motor (not shown) to thereby provide mobility for the apparatus 100. The motor to drive the tracks 104 may be electric or fuel powered.

Mounted on the platform 102 may be a generator 106. In an embodiment of the present disclosure, the generator 106 may be a diesel powered generator. A fuel tank (not shown) may provide fuel to the generator 106. In an embodiment of the present disclosure, the generator 106 may be approximately a 150 kilowatt generator.

Disposed below the platform 102 may be a heater 108. The heater 108 may comprise a first side portion 108A, a center portion 108B, and a second side portion 108C. Each of the first side portion 108A, the center portion 108B, and the second side portion 108C may comprise a plurality of electrical heating elements similar to the heating elements 54 depicted in FIGS. 2 and 3. The heating elements for the first side portion 108A, the center portion 108B, and the second side portion 108C may be powered by the generator 106. In particular, the heat output of the heating elements for the first side portion 108A, the center portion 108B, and the second side portion 108C may be dependent upon the electrical energy provided by the generator 106. The heat output of the heater 108 may be controllable via a control panel (not shown).

In an embodiment of the present disclosure, the operating temperature of the heating elements for the first side portion 108A, the center portion 108B, and the second side portion 108C may be about 600 to 1000 degrees Fahrenheit. In an embodiment of the present disclosure, the heat output of the heating elements for the first side portion 108A, the center portion 108B, and the second side portion 108C may be about 800 degrees Fahrenheit. In an embodiment of the present disclosure, the heating elements may heat the asphalt to about 250 to 350 degrees Fahrenheit, or about 300 degrees Fahrenheit.

In an embodiment of the present disclosure, the vertical height of the heater 108 may be variable as shown by the double arrows marked with the reference numeral 112. In particular, a hydraulic system 110 may be operable to move the heater 108 between a raised position and a lowered position. In an embodiment of the present disclosure, the lowered position of the heater 108 may be only a few inches above the surface desired to be heated. The hydraulic system 110 may be powered by an electric or gas/diesel motor (not shown).

As best shown in FIG. 4, the side portions 108A and 108C of the heater 108 may also be pivotally raised by the hydraulic system 110 around pivots 114 and 116, respectively, as shown by the double arrows marked with the reference numerals 118 and 120, respectively. The side portions 108A and 108C of the heater 108 may be pivotally raised from a horizontal orientation to nearly a vertical orientation. It will be appreciated that this feature allows the side portions 108A and 108C to be pivotally raised for storage and transport.

The platform 102 may provide sufficient space such that an operator may stand on it while the apparatus 100 is in operation. Alternatively, the operator may walk or stand beside the apparatus 100 while the apparatus 100 is in use. A control panel (not shown) may be utilized to start the generator 102 and adjust the heat output of the heating elements of the heater 108. The apparatus 100 may be positioned above a void in asphalt, such as a crack or a pothole. In addition, the apparatus 100 may be positioned near an edge or end of laid asphalt.

Figure 7A:
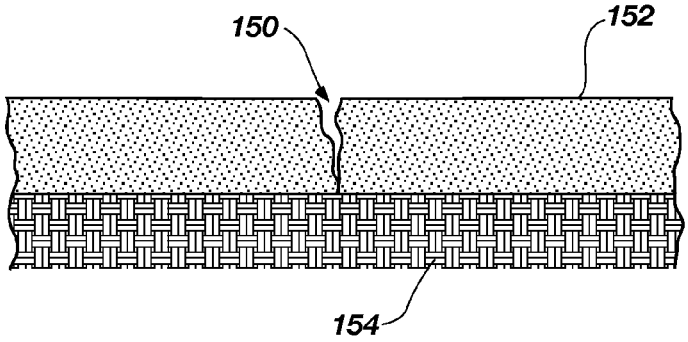
FIGS. 7A-7D depict an exemplary process for repairing a void in asphalt.
Figure 7B:
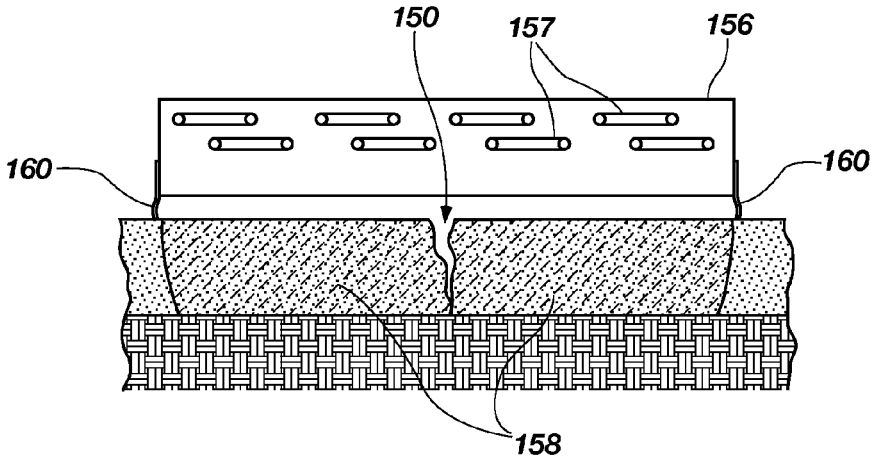

Referring now to FIGS. 7A-7D, there is depicted a method suitable for repairing a crack 150 in asphalt pavement 152. As can be observed in FIG. 7A, the crack 150 may extend to a base material 154. In FIG. 7B, a heater 156 is positioned over the crack 150. The heater 156 may include a plurality of electrical heating elements 157 and a skirt 160. In an embodiment of the present disclosure, the heating elements 157 may be powered by a generator. The heater 156 should be of sufficient size to heat sections 158 of the asphalt pavement 152 on either side of the crack 150.

Figure 7C:
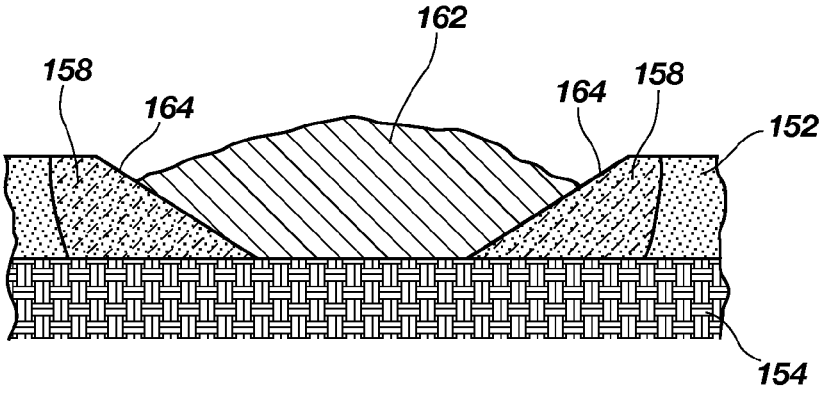

Once the sections 158 on either side of the crack 150 have been heated to a sufficient degree, a portion 162 the sections 158 is broken apart, e.g., by tilling or grinding, and mixed in place as shown in FIG. 7C. The sides 164 may slope inward. An asphalt rejuvenator may be mixed into the broken up portion 162. In an embodiment of the present disclosure, the asphalt rejuvenator may be a petroleum based product, such as an oil, or some other binding agent. Additional aggregate material or fresh asphalt may also be added at this time, if needed.

Figure 7D:
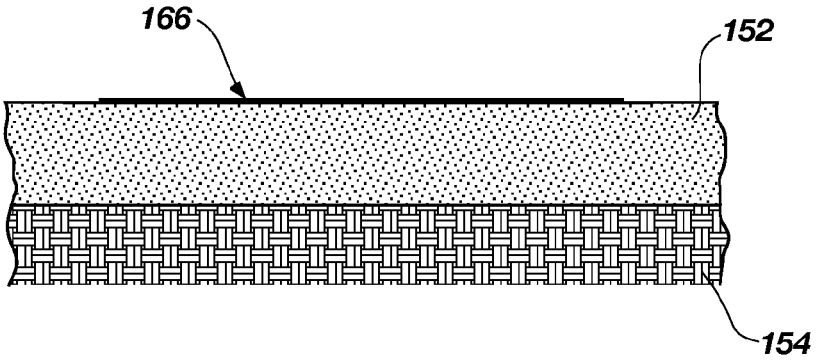

As seen in FIG. 7D, the sections 158 are then compacted using a steel drum roller, for example, into a flat surface. A seal coat 166 may also be applied to the surface of the asphalt 152. It will be appreciated that the above described process allows asphalt to be repaired in place. In particular, the above described process heats existing asphalt pavement in place using electrical heating elements connected to a generator. The above described process may be utilized to repair not only cracks, but other problem areas in asphalt pavement, including potholes, deformities, and irregularities in an asphalt surface. Thus, the above described process may be useful for repairing all types of voids in asphalt pavement. In an embodiment of the present disclosure, the heater 156 may take the form of the apparatuses 10 and 100.

Figure 8A:
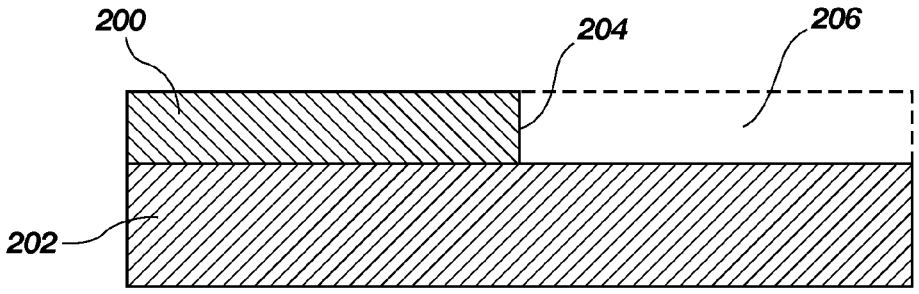
FIGS. 8A-8C depict an exemplary process for laying to adjacent sections of asphalt.
Figure 8B:
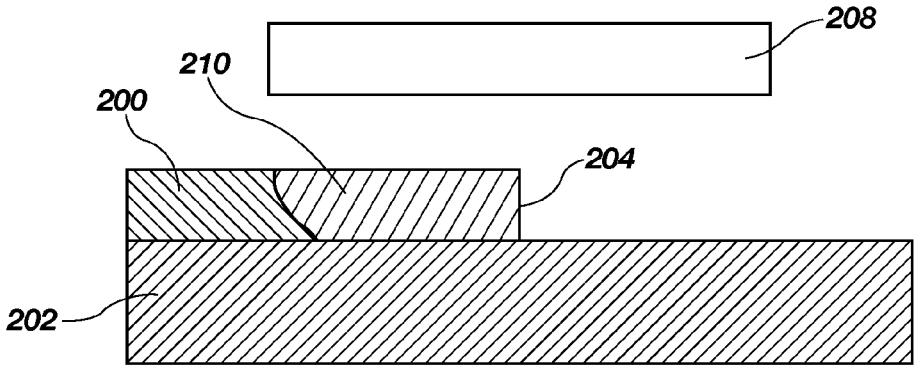
Figure 8C:
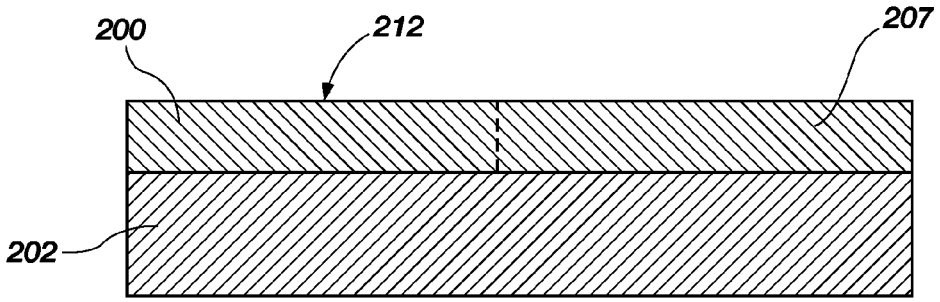

Referring now to FIGS. 8A-8C, there is depicted a process for improving a joint between two sections of asphalt laid side by side at separate times. As shown in FIG. 8A, a first section 200 of asphalt may be laid on a base material 202. The section 200 may have an end 204. A space 206, indicated by the dashed lines, adjacent to the end 204 is reserved for another section of asphalt. Due to the passage of time, the section 200 of asphalt, including the end 204, may harden as it cools to ambient temperature after it is laid. This may be undesirable as the asphalt laid in the space 206 next to the end 204 is "hot." The end result of laying "hot" asphalt next to the section 200 of asphalt is that the joint formed at end 204 is compromised. For example, the joint could be subject to cracks and potholes.

In order to provide an improved joint, or even eliminate it altogether, as shown in FIG. 8B, a heater 208 is placed above the section 200 of asphalt near the end 204 to thereby heat a portion 210 of the asphalt near the end 204. The heater 208 may include electrical heating elements powered by a generator, such as a diesel powered generator. When the portion 210 has reached sufficient temperature, e.g., close to the temperature of fresh asphalt or between about 600 and 1000 degrees Fahrenheit, an adjacent section 207 of asphalt may be laid next to the section 200 as shown in FIG. 8C to form an asphalt surface 212. The asphalt surface 212 may then be rolled as is known to one having ordinary skill in the art to a flat surface, such as a road or a parking lot. Because the portion 210 was re-heated by the heater 208, a joint or seam between two laid sections may be non-existent. In an embodiment of the present disclosure, the heater 208 may take the form of one of the apparatuses 10 and 100.

Figure 9:
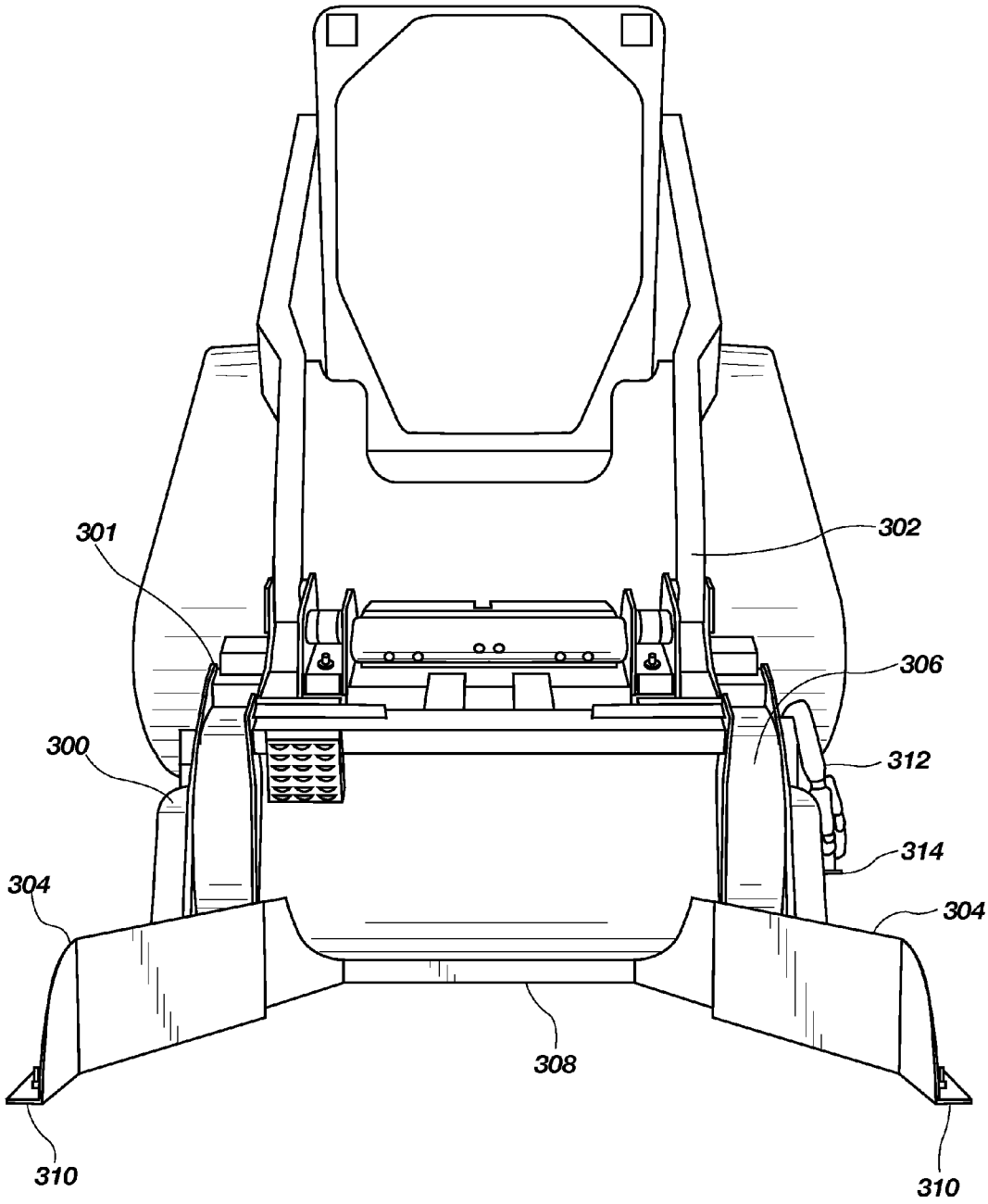
FIG. 9 depicts a front view of a multipurpose asphalt processor pursuant to an embodiment of the present disclosure.

Referring now to FIG. 9, there is depicted a front view of an asphalt processor 300 pursuant to an embodiment of the present disclosure. The asphalt processor 300 may be mounted on a tractor 302. The asphalt processor 300 may include a frame 301 having a housing 306. A pair of arms 304 may extend from the frame 301. The arms 304 may extend outwardly, such as in a Y-shape, from the housing 306. The arms 304 may guide broken-up asphalt to a screed portion 308 connected to the lower portion of the housing 306. A wear/skid plate 310 may be mounted on a lower surface of each of the arms 304.

Hydraulic hoses 312 may be connected to a hydraulic system (not shown) of the tractor 302. The hydraulic hoses 312 may be connected to a hydraulic motor 314 mounted on the side of the housing 306. As will be explained in more detail hereinafter, the hydraulic motor 314 may be operable to drive a tiller shaft.

Figure 10:
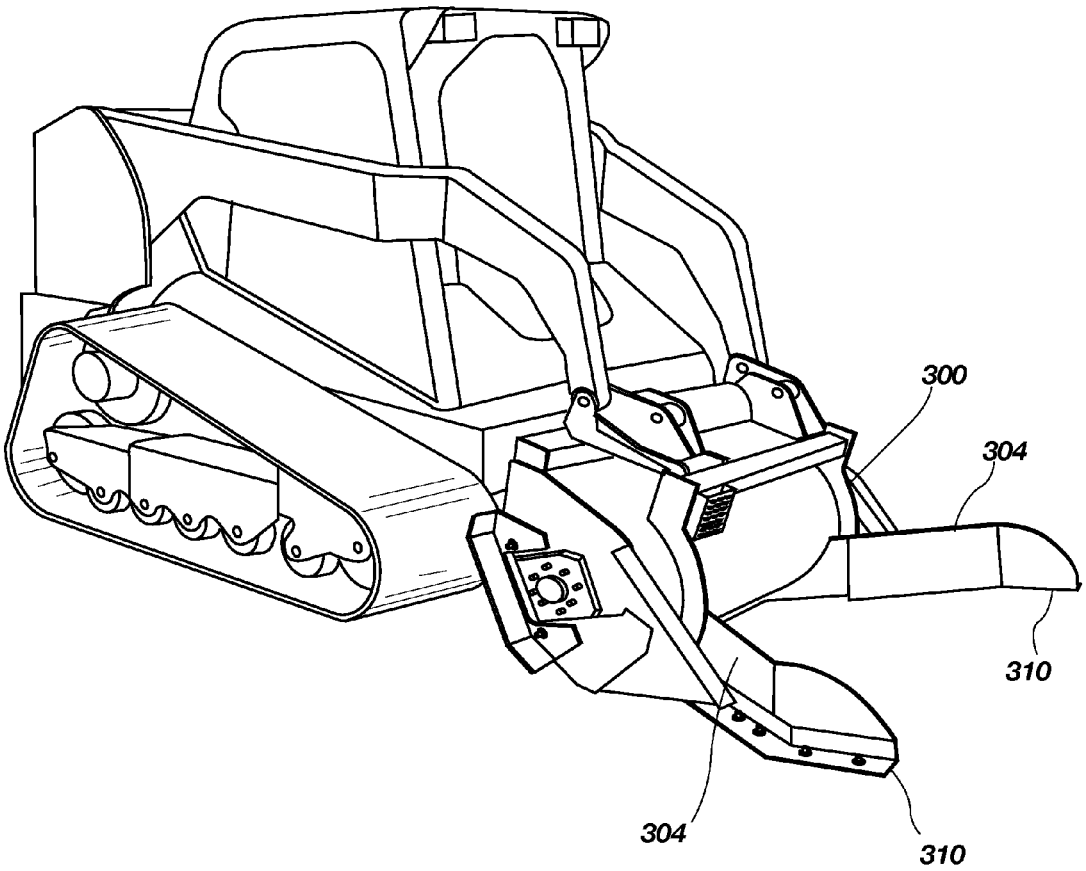
FIG. 10 depicts a side view of the multipurpose asphalt processor mounted on machinery and in the lowered position.
Figure 11:
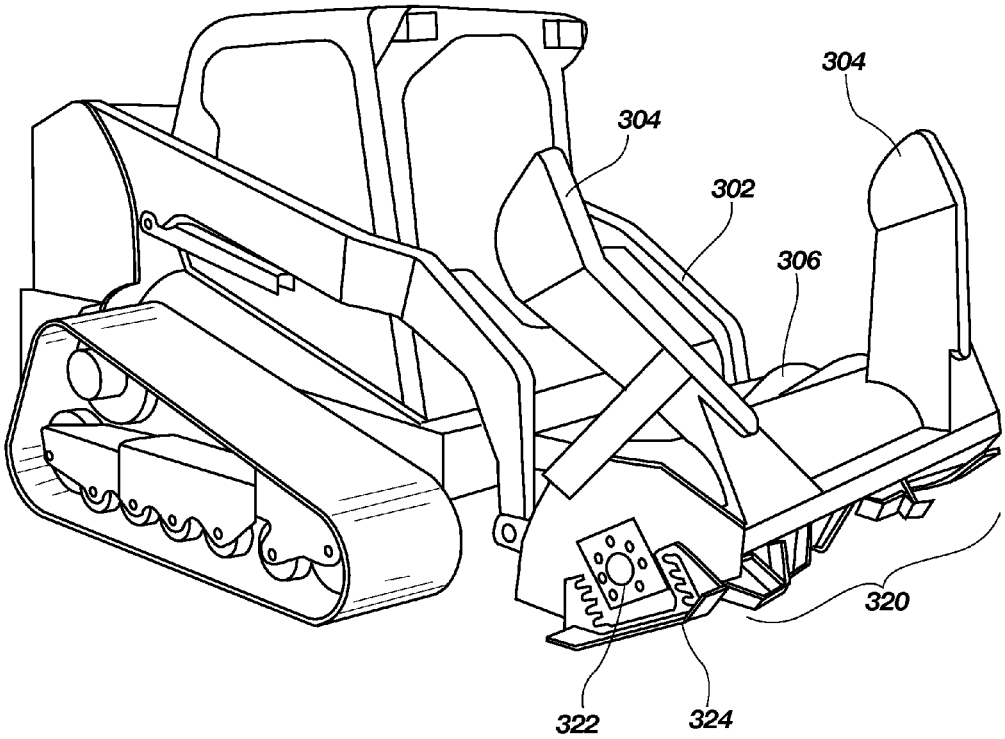
FIG. 11 depicts a side view of the multipurpose asphalt processor mounted on machinery and in the raised position.
Figure 12:
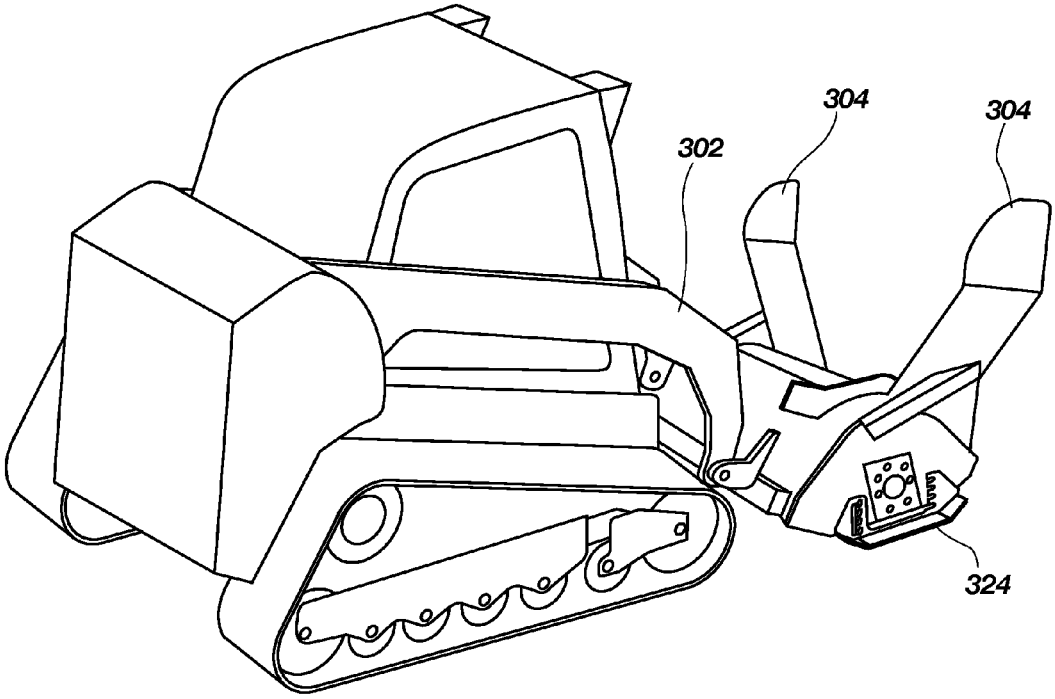
FIG. 12 depicts a view of the multipurpose asphalt processor mounted on machinery and in the raised position.

Referring now to FIGS. 9, 10, 11 and 12, the asphalt processor 300 may be operable and positionable between a first position as shown in FIGS. 9 and 10 and a second position as shown in FIGS. 11 and 12. In the first position, the arms 304 of the processor 300 may extend parallel to the ground and such that the wear plates 310 are in contact with the ground. In the second position, the housing 306 may be rotated to thereby raise the arms 304 out of contact with the ground and to thereby expose a set of tines 320 mounted to a shaft 322 as shown in FIG. 11. The shaft 322 may be driven by the hydraulic motor 314 (see FIG. 9). In the second position, the housing 306 may ride on a wear/skid plates 324. The wear plates 324 may be adjustable in height such that the depth of the tines 320 may be variable.

Figure 13:
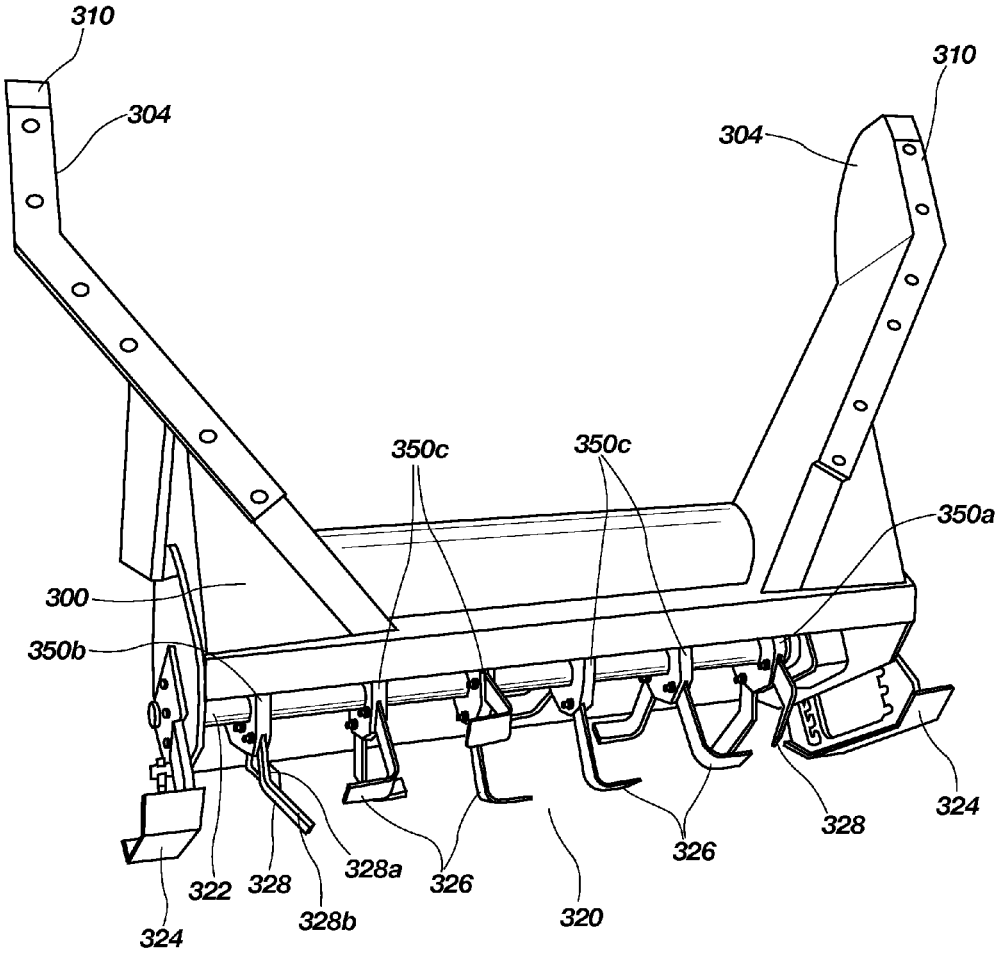
FIG. 13 depicts a view of the tiller and tines of the multipurpose asphalt processor.

Referring now to FIG. 13, there is depicted a view of the asphalt processor 300. Dispersed along the shaft 322 may be a plurality of hubs 350*a*, 350*b*, and 350*c* configured and adapted for receiving tines 320. In particular, the shaft 322 may comprise an outermost hub 350*a* and an outermost hub 350*b*. The shaft 322 may further comprise one or more interior hubs 350*c*. The interior hubs 350*c* may be disposed on the shaft 322 between the outermost hub 350*a* and the outermost hub 350*b*. Sets of tines 320 may be attached to each of the hubs 350*a*, 350*b*, and 350*c*.

As can be observed, the hubs 350*a*, 350*b*, and 350*c* may allow tines 320 to be attached to the shaft 322. Each hub 350*a*, 350*b*, or 350*c* may allow tines 320 to be attached in a spoke pattern around the shaft 322. In an embodiment of the present disclosure, the configuration of tines 320 attached to the outermost hub 350*a* and the outermost hub 350*b* differs from the configuration of the tines 320 attached to the interior hubs 350*c*.

It will be observed that the set of tines 320 includes inner tines 326 and outer tines 328. The inner tines 326 are attached to the interior hubs 350*c*. As can be observed, the inner tines 326 may be substantially L-shaped. On any given interior hub 350*c*, alternate ones of the inner tines 326 may face opposite directions.

The outer tines 328 are attached to the outermost hubs 350*a* and 350*b*. The outer tines 328 may include a first or attachment portion 328*a* that extends radially outward from the shaft 322 and a second portion 328*b* that extends inwardly towards the interior hubs 350*c*. It will be appreciated that a cutting edge of the outer tines 328 are all angled inwardly to thereby form a beveled surface in the asphalt. In an embodiment of the present disclosure, the tines 328 attached to the outermost hubs 350*a* and 350*b* may include an inwardly angled cutting edge such that a beveled surface may be formed along the edges of a tilled portion of asphalt.

In an embodiment of the present disclosure, none of the tines 328 attached to the outermost hubs 350*a* and 350*b* include a cutting edge that would disrupt formation of a beveled surface formed by the tines 328. All of the tines 328 attached to the outermost hubs 350*a* and 350*b* may include a cutting edge that angles inwardly such that a beveled surface may be formed along the edges of a tilled portion of the asphalt.

Figure 14:
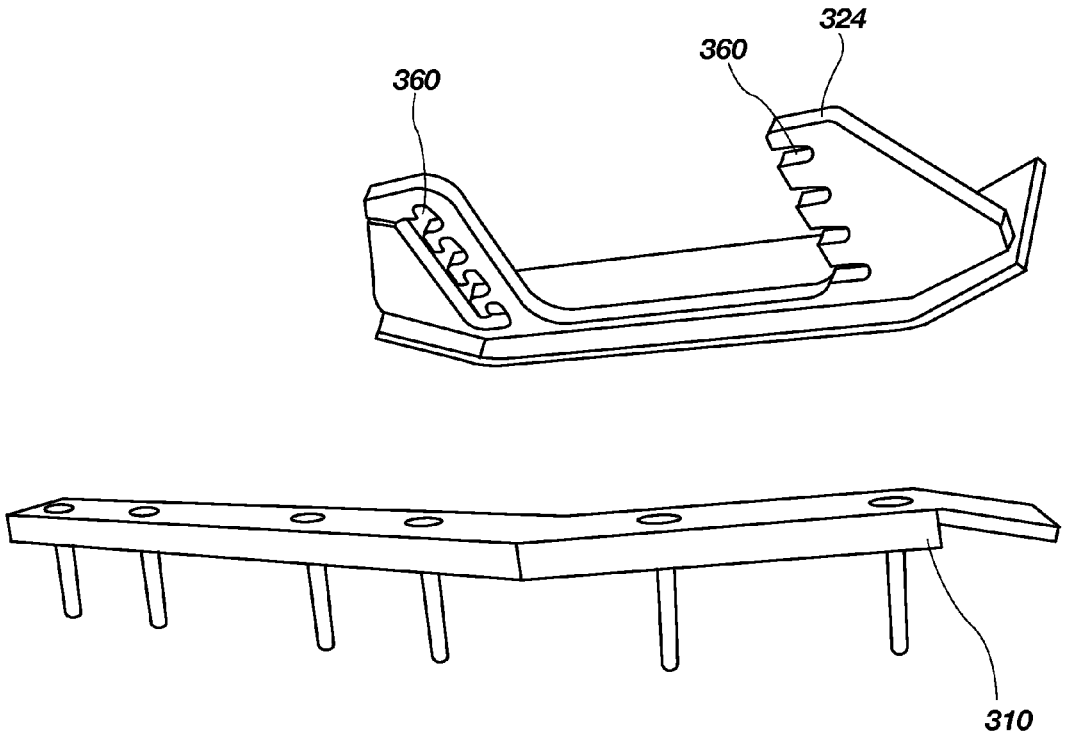
FIG. 14 depicts a view of the wear plates for the asphalt processor.
Figure 15:
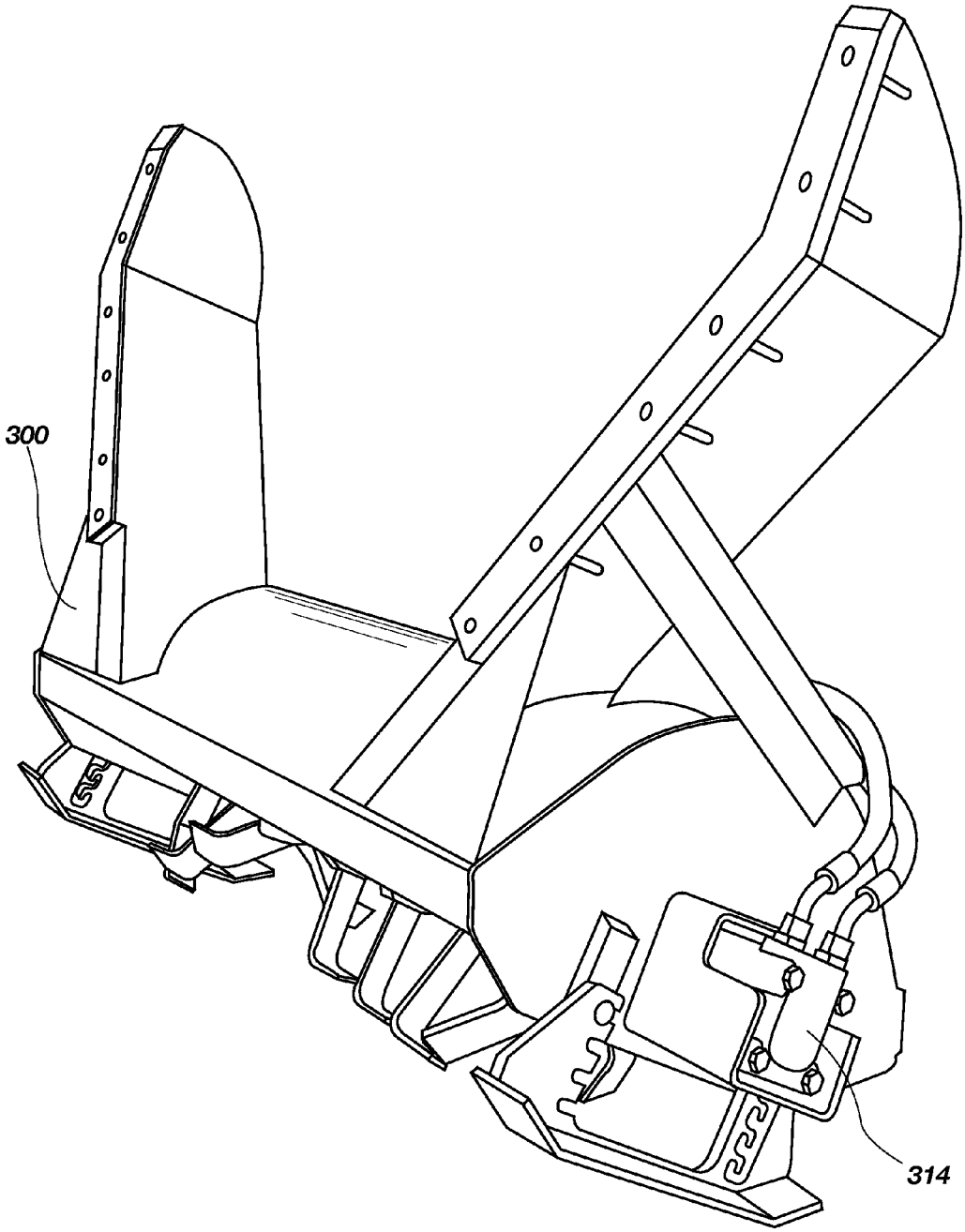
FIG. 15 depicts a view of the multipurpose asphalt processor.

Referring now to FIG. 14, there is depicted a view of the wear or skid plate 310 and the wear or skid plate 324. The plate 324 may include notches to thereby adjust the cutting depth of the tines 320. Referring to FIG. 15, there is depicted a view of the asphalt processor 300 and the hydraulic motor 314 for turning the shaft 322. Hoses may connect the motor 314 to a hydraulic system of a tractor.

Figure 16:
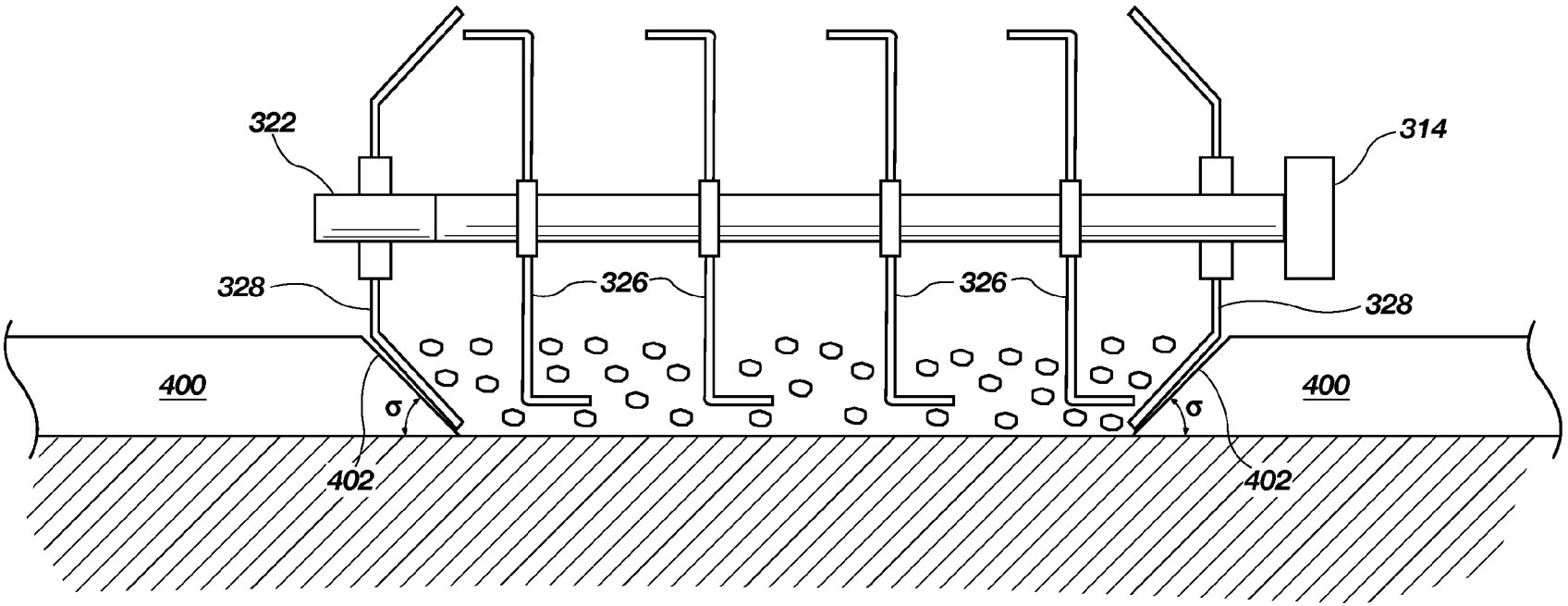
FIG. 16 depicts a shaft with tines for tilling asphalt.
Figure 17:
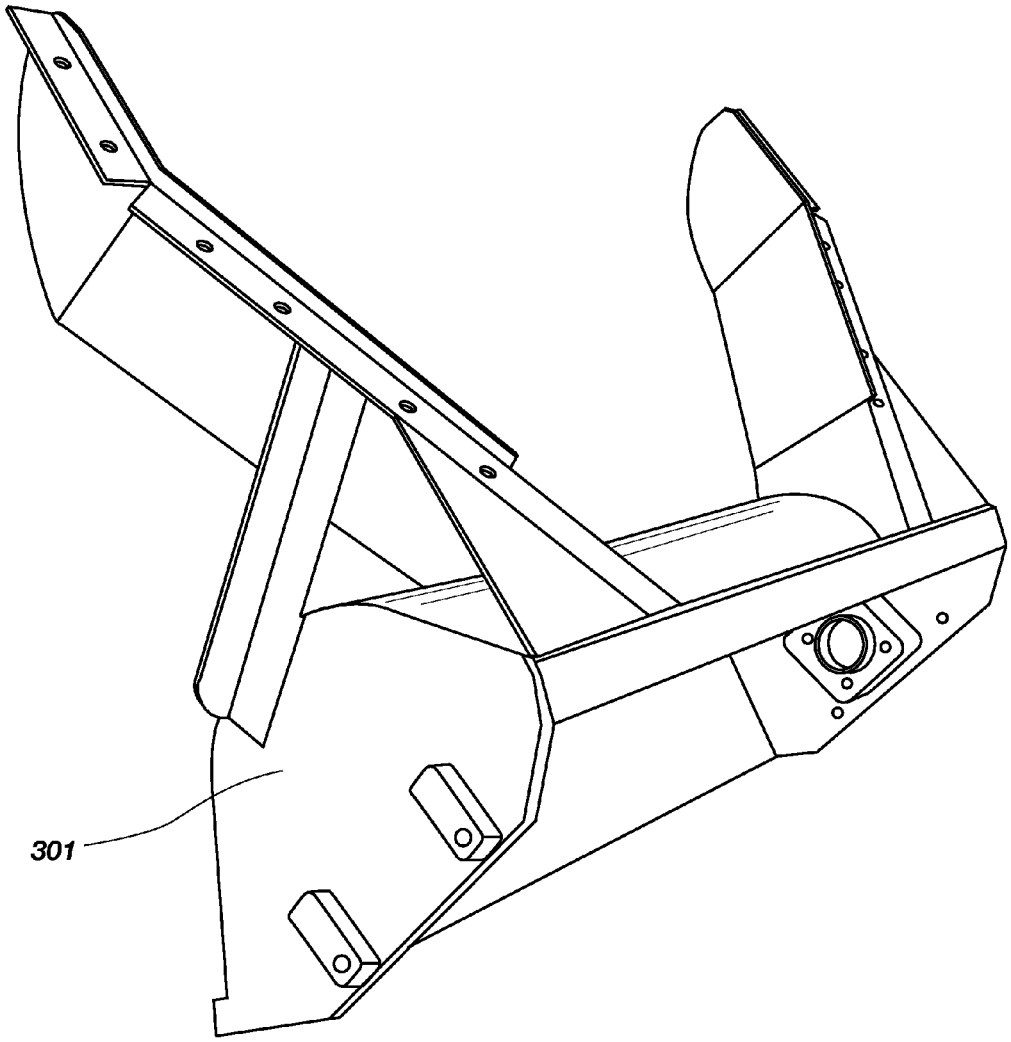
FIGS. 17 and 18 show a frame of the asphalt processor.
Figure 18:
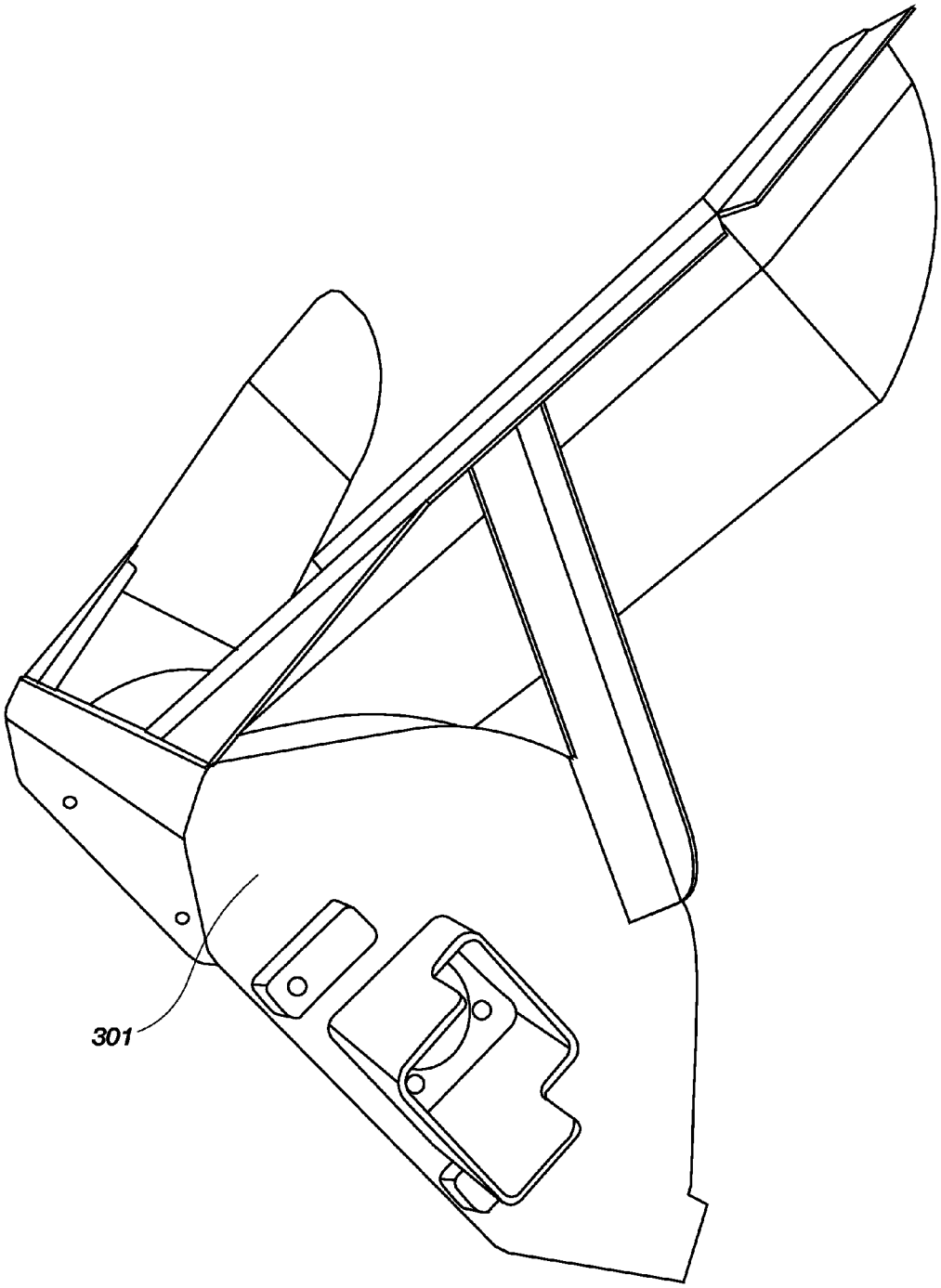

Referring now to FIG. 16, there is shown a view of the shaft 322 and the outer tines 328 and the inner tines 326 in use. In particular, the motor 314 may drive the shaft 322 such that the tines 326 and 328 break up a damaged portion of an asphalt surface 400. As can be observed, the angle of the cutting edges of the outer tines 328 forms beveled edges 402 in the asphalt surface 400 along the edges of the portion broken up by the asphalt processor. In an embodiment of the present disclosure, the angle of the beveled portion may be about 45 degrees. In an embodiment of the present disclosure, the angle of the cutting edges of the outer tines 328 may be about 45 degrees.

Referring back to FIG. 9, the screed 308 may travel above the asphalt surface such that, when re-compacted, the broken up portion of the asphalt is level with the original asphalt surface. In an embodiment of the present disclosure, the screed 308 may travel 1 to 5 inches above the original asphalt surface, such that when the asphalt is compacted, it is substantially level with original asphalt surface.

In accordance with the features and combinations described above, a useful method of repairing a damaged section of asphalt includes the steps of:

(a) heating the damaged section of asphalt;

(b) breaking up the damaged section of asphalt using a plurality of tines mounted on a rotating shaft;

(c) adding rejuvenator to the broken up asphalt;

(e) using a screed to level the broken up asphalt; and (f) compacting the broken up asphalt.

In accordance with the features and combinations described above, an embodiment of the present disclosure may comprise:

a rotatable shaft member having a first end and a second end;

a plurality of sets of tines extending from the shaft member;

the plurality of sets of tines including a first outermost set of tines, a second outermost set of tines, and at least one set of inner tines located on the shaft member between the first outermost set of tines and the second outermost set of tines;

wherein each of the first outermost set of tines comprises an attachment portion that extends radially outward from the shaft member and a cutting edge that angles inwardly towards the at least one set of inner tines;

wherein each of the second outermost set of tines comprises an attachment portion that extends radially outward from the shaft member and a cutting edge that angles inwardly towards the at least one set of inner tines;

wherein none of the plurality of sets of tines extending from the shaft member disrupt the beveled edges formed in the asphalt by the first outermost set of tines and the second outermost set of tines.

Those having ordinary skill in the relevant art will appreciate the advantages provide by the features of the present disclosure. For example, it is a feature of the present disclosure to provide an infrared heating device for melting snow and ice. Another feature of the present disclosure is to provide such a heating device capable of being removably attached to a hydraulic arm of an excavating machine. Still another feature of the present disclosure allows asphalt to be repaired by heating sections of the asphalt in place. Yet still another feature of the present invention improves joint strength between two sections of asphalt.

In the foregoing Detailed Description, various features of the present disclosure are grouped together in a single embodiment for the purpose of streamlining the disclosure.

This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. An apparatus for tilling asphalt, said apparatus comprising:

a rotatable shaft member having a first end and a second end;

a plurality of sets of tines extending outwardly from the shaft member;

the plurality of sets of tines including a first outermost set of tines, a second outermost set of tines, and at least one set of inner tines extending outwardly from the shaft member and positioned between the first outermost set of tines and the second outermost set of tines;

wherein each of the first outermost set of tines comprises a first end interconnected to the shaft and a cutting edge on a second end that angles inwardly towards the at least one set of inner tines capable of forming a first beveled edge in the asphalt, wherein a first thickness of each of the first outermost set of tines between the first end and the second end is substantially uniform;

wherein each of the second outermost set of tines comprises a third end interconnected to the shaft and a cutting edge on a fourth end that angles inwardly towards the at least one set of inner tines capable of forming a second beveled edge in the asphalt, wherein a second thickness of each of the second outermost set of tines between the third end and the fourth end is substantially uniform;

wherein the inner sets of tines extending from the shaft member are capable of forming a substantially flat bottom surface without disrupting the beveled edges formed in the asphalt by the first outermost set of tines and the second outermost set of tines, and wherein the apparatus is capable of forming a void with uncompacted asphalt comprising the first beveled edge, the second beveled edge, and the substantially flat bottom surface between the first and second beveled edges.

2. The apparatus of claim 1, further comprising:

a plurality of hubs distributed along the shaft member, each of the plurality of hubs configured and adapted for receiving an end portion of one of the plurality of sets of tines; and the plurality of hubs comprising a first outermost hub nearest the first end of the shaft member, a second outermost hub nearest the second end of the shaft member, and at least one interior hub located between the outermost hub and the second outermost hub on the shaft member;

wherein the first outermost set of tines are attached to the first outermost hub;

wherein the second outermost set of tines are attached to the second outermost hub.

3. The apparatus of claim 1, further comprising a motor for rotating said shaft member.

4. The apparatus of claim 1, wherein each of the at least one set of inner tines is L-shaped.

5. The apparatus of claim 4, wherein alternate ones of the L-shaped tines extend in opposite directions.

6. The apparatus of claim 1, further comprising at least one skid plate operable to set a running depth of the plurality of sets of tines.

7. The apparatus of claim 6, wherein the at least one skid plate comprises a pair of spaced apart skid plates, wherein the shaft member extends between the pair of skid plates.

8. The apparatus of claim 7, wherein the pair of skid plates are operable between a first position and a second position, wherein the running depth of the tines is greater in the first position than in the second position.

9. The apparatus of claim 1, further comprising at least two skid plates positioned proximate to opposite ends of the shaft member and adjustable to selectively set a running depth of the plurality of sets of tines.

10. The apparatus of claim 1, wherein the first beveled edge and the second beveled edge are oriented inwardly at angles of approximately 45 degrees with respect to a longitudinal axis of the tines.

11. The apparatus of claim 1, further comprising a housing substantially enclosing the plurality of sets of tines to retain asphalt broken up from the tines in a retained space.

12. The apparatus of claim 1, wherein each of the at least one set of inner tines comprise a planar cutting edge oriented at angles approximately 90 degrees with respect to a longitudinal axis of the tines.

13. The apparatus of claim 1, further comprising a screed structure including at least two arm structures, wherein the apparatus is configured to operate in at least two positions, the first position operable to till asphalt with the plurality of sets of tines, and a second position operable to screed asphalt with the screed structure, wherein when the apparatus is in the first position the screed structure is positioned substantially above the plurality of sets of tines, and when the apparatus is in the second position the plurality of sets of tines are positioned behind the screed structure and unable to engage the asphalt.

* * * * *